United States Patent [19]

Loeffler

[11] Patent Number: 4,823,770

[45] Date of Patent: Apr. 25, 1989

[54] COMBINATION HYDRONIC SPACE HEATER AND TANKLESS HOT WATER HEATER

[75] Inventor: Herbert H. Loeffler, Arlington, Mass.

[73] Assignee: Logical Heating Systems, Inc., Manchester, Conn.

[21] Appl. No.: 80,777

[22] Filed: Aug. 3, 1987

[51] Int. Cl.[4] ..... F24H 1/00; F22B 5/00

[52] U.S. Cl. ..... 126/362; 122/17; 126/365

[58] Field of Search ..... 126/362, 361, 366, 360 R, 126/350 R, 365, 364; 237/19, 56, 51, 59; 122/10, 17, 49, 23, 135 F

[56] References Cited

U.S. PATENT DOCUMENTS

| | | | |
|---|---|---|---|
| 1,948,064 | 2/1934 | Cartter | 122/17 |
| 2,024,437 | 12/1935 | Eisinga | 122/17 |
| 2,311,469 | 2/1943 | Pruitt | 126/362 |
| 2,334,398 | 11/1943 | Farren et al. | 122/17 |
| 2,503,883 | 4/1950 | Miller | 126/350 X |
| 2,613,653 | 10/1952 | Wald | 126/362 |
| 2,642,046 | 6/1953 | Alexander | 126/362 X |
| 3,251,346 | 5/1966 | Merino | 122/17 |
| 4,257,355 | 3/1981 | Cook | 126/362 X |
| 4,479,605 | 10/1984 | Billotte et al. | 237/19 X |
| 4,641,631 | 2/1987 | Jatana | 126/362 X |

*Primary Examiner*—Randall L. Green

*Attorney, Agent, or Firm*—John H. Crozier

[57] ABSTRACT

A combination space heating and tankless hot water heater includes a vertical closed tank, having upper and lower ends, adapted to hold a large reservoir of liquid heat transfer medium therewithin. A high-efficiency gas/liquid heat exchanger, having upper and lower ends, is disposed within the tank, with the upper end of the gas/liquid heat exchanger at the upper end of the tank and the lower end of the gas/liquid heat exchanger at the lower end of the tank. A burner is disposed at the lower end of the gas/liquid heat exchanger to provide hot gases to flow upwards through the gas/liquid heat exchanger for transfer of heat from the gases across the walls of the gas/liquid heat exchanger and to the heat transfer medium. Means for withdrawing and returning the heat transfer medium from and to the tank for forced circulation for space heating are provided and a heat exchanger is disposed within said tank for receiving cold water and supplying domestic hot water. By means of proper combustion air flow management, including a unique arrangement of combustion air paths, large efficient heat exchange area, and efficient insulation, close to the theoretical limit of efficiency is obtained for a noncondensing embodiment described. In a preferred embodiment, the unit is constructed entirely of stainless steel, except for the domestic hot water heat exchanger which is fabricated of copper or copper alloy.

3 Claims, 1 Drawing Sheet

FIG. 1
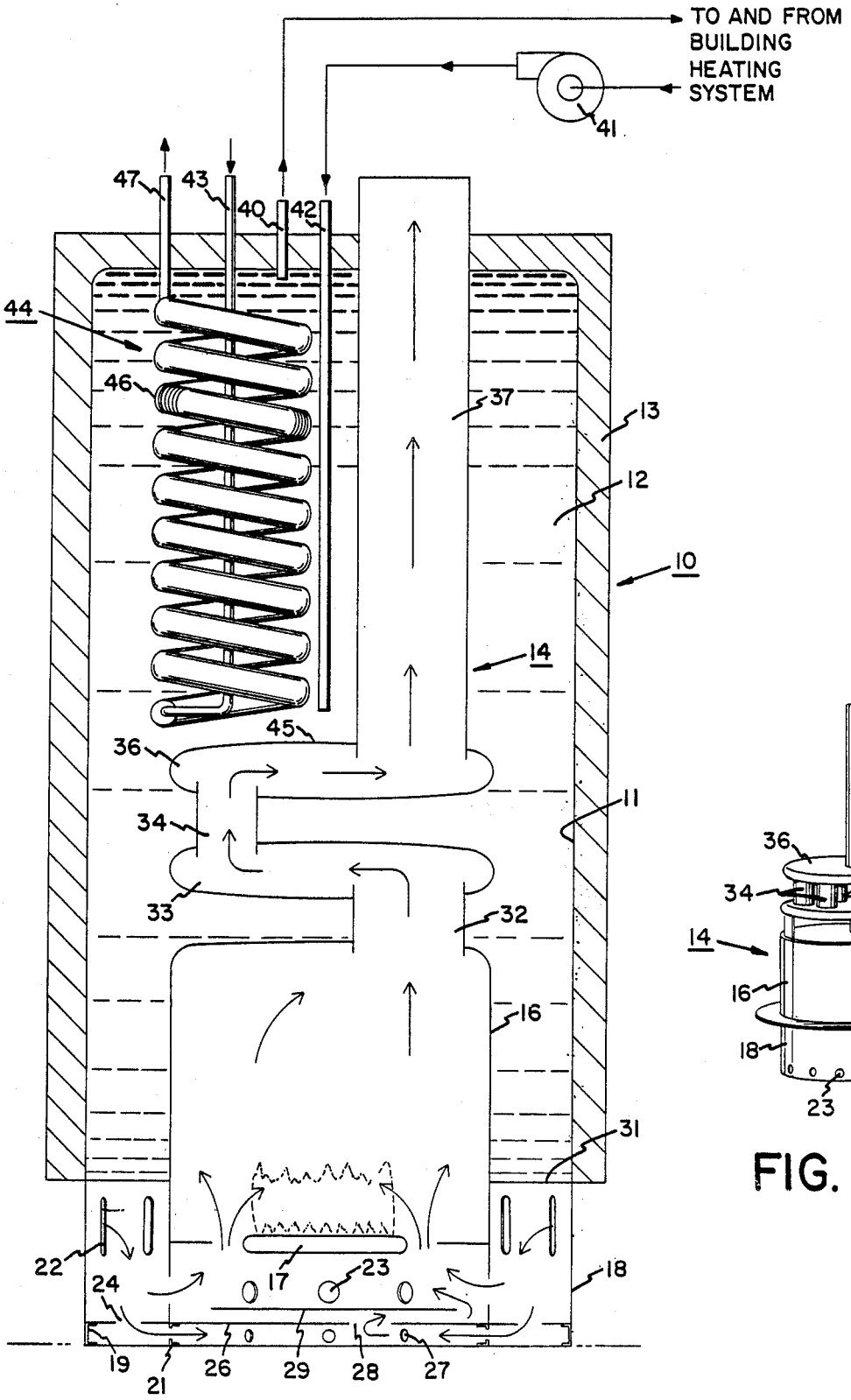
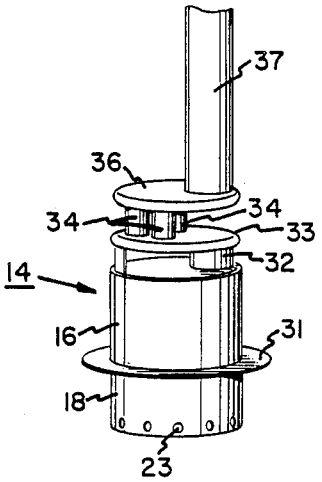
FIG. 2

COMBINATION HYDRONIC SPACE HEATER AND TANKLESS HOT WATER HEATER

BACKGROUND OF THE INVENTION

1. Field of the Invention.

This invention relates generally to hot water heating, and more particularly to a unique, high-efficiency hot water heater that satisfies space heating requirements, while simultaneously supplying domestic hot water in a single unit.

2. Background Art.

A typical, conventional hydronic space heating system is a closed hot water system in which hot water is circulated from a heater, or "boiler", to radiators in a building, which radiators transfer heat from the water to the surrounding air, with the now cooler water being returned to the heater. The heater typically includes a relatively small water reservoir heated by a relatively large burner fueled by either oil or gas. The system is usually controlled by a thermostat in the building which, when the temperature in the building falls to a predetermined level, causes the hot water in the reservoir to circulate through the finned devices. A second thermostat associated with the heater controls the burner to heat the water therein when it falls to a minimum temperature. Because the reservoir is small, resulting in a low quantity of heat storage, the burner must be of relatively large capacity, in order to meet the nearly instantaneous large heat demand.

In some systems, the burner cannot meet the instantaneous heat demand. Consequently, as cooler water returns to the reservoir from the radiators in the building, the temperature of the water in the reservoir drops and controls on the heater stop the flow of water through the system until the temperature of the water in the reservoir reaches a certain level. This cycling on and off of the water circulation means that the building will not be heated as rapidly as would otherwise be the case with a larger heated reservoir. Since most combustion systems must reach a certain temperature level before efficient operation is attained, the cycling on and off of the burner in such systems means that fuel is not as efficiently used as would otherwise be the case.

In the case of domestic hot water heaters, on the other hand, there is typically a relatively large reservoir of hot water heated by a relatively small burner. The result is that the burner cannot meet the instantaneous demand for hot water, but the large reservoir of hot water is usually, but not always, sufficient to supply ordinary demands. Because such heaters are frequently of low heating capacity, on the order, say, of 25,000 BTU per hour, it is not usually economical to construct them to be of high efficiency.

Accordingly, it is a principal object of the present invention to provide a combination heating unit which will provide both space heating requirements and domestic hot water requirements in a single unit.

It is another object of the present invention to provide such a combination heating unit that is compact and of high efficiency.

It is an additional object of the present invention to provide such a combination heating unit that is constructed to have a long service life.

Other objects of the present invention will in part be obvious and will in part appear hereinafter.

SUMMARY OF THE INVENTION

The present invention overcomes the limitations of conventional heating devices by providing a compact, high-efficiency unit which furnishes space heating requirements and can satisfy instantaneous heating demands in excess of burner capacity for a reasonably long period of time, while furnishing domestic hot water requirements without need for a separate reservoir for this purpose.

Briefly described, the unit of the present invention includes a closed vertical cylinder filled with a heat transfer medium, with a generally centrally disposed gas/liquid heat exchanger therein, the heat exchanger having a cylindrical combustion chamber disposed in its lower end, and with heat produced by an external-mix burner. The combustion gases flow upward through the combustion chamber where some heat is given up to the surrounding water, upwards into a second heat exchange member for additional heat transfer to the water, upwards into a third heat exchange member, and then through a vent stack to a flue. By means of proper combustion air flow management, including a unique arrangement of combustion air flow paths, large efficient heat exchange area, and efficient insulation, close to the theoretical limit of efficiency is obtained for a noncondensing embodiment described. Domestic hot water is provided by a water-to-water heat exchanger coil in the tank and a tempering valve may be included at the outlet to admix cold water, if required, to provide domestic hot water at a stable and usable temperature. In an embodiment described for household use, a heater rated at 100,000 BTU per hour with a reservoir of 60 gallons of water (about the size of a large domestic hot water heater), the unit has an instantaneous heating capacity of more than 100,000 BTU per hour and can supply far more domestic hot water than conventional solely domestic hot water systems of comparable size. When constructed of stainless steel, the unit is intended as a premium residential installation offering maximum reliably, long life, and high fuel efficiency.

BRIEF DESCRIPTION OF THE DRAWING

FIG. 1 is a cross-sectional view of the heater of the present invention.

FIG. 2 is a perspective view of the gas-to-water heat exchanger of the present invention.

DETAILED DESCRIPTION OF THE INVENTION

Referring now to the drawing, FIG. 1 shows a combination space heater and domestic hot water heater of the present invention, generally indicated by the reference numeral 10, which includes a vertical cylindrical closed tank 11 filled with a liquid heat transfer medium 12 which is preferably, but not necessarily, water. Tank 11 is enclosed in insulation 13 on its sides and top. Generally centrally disposed within heater 10 and axially aligned therewith is a high-efficiency gas/liquid heat exchanger 14 and disposed at the base of which heat exchanger is a cylindrical combustion chamber 16, axially aligned with the tank and enclosing a burner 17 at its lower end. Heater 10 is supported by a cylindrical skirt 18. Ring channels 19 and 21 provide rigidity and support for skirt 18 and gas/liquid heat exchanger 14, respectively.

Combustion air for burner 17, the flow of which is indicated by arrows on FIG. 1, enters heater 10 by way of first and second air flow paths. The air in the first air flow path enters heater 10 through a first plurality of holes, as at 22, defined in skirt 18. Some of this air then flows into combustion chamber 16 through a second plurality of holes, as at 23, defined in the wall of the combustion chamber. The air in the second air flow path flows through a third plurality of holes, as at 24, defined in a circular plate 26 which is also the bottom of combustion chamber 16. The latter air then flows over a portion of the surface upon which heater 10 rests and through a fourth plurality of holes, as at 27, defined in ring channel 21, then over a further portion of the surface upon which heater 10 rests and upward through a fifth plurality of holes, as at 28, defined in the portion of plate 26 comprising the bottom of combustion chamber 16, then underneath and around a baffle plate 29, and then to burner 17.

The air flow arrangement shown on FIG. 1 makes an important contribution to the efficiency of the heater of the present invention. Air in the first air flow path cools a portion of skirt 18, and recaptures lost heat from the wall of combustion chamber 16 and from the underside of annular plate 31, which partially forms the lower end of tank 11, and from plate 26. In addition, its flow through holes 23 helps prevent convective heat transfer from combustion chamber 16 to the surroundings. The air in the second air flow path also cools a portion of skirt 18, recaptures lost heat from the wall of combustion chamber 16 and from plates 26 and 31. In addition, this air flow recaptures lost heat from ring channel 21 and, after entering the space defined by that channel, recaptures additional heat from the portion of plate 26 comprising the lower end of combustion chamber 16 and from baffle plate 29 and also prevents convective heat transfer from the combustion chamber. An important efficiency-enhancing function is provided by plate 26 and baffle plate 29 in that they form a labyrinth arrangement, thus minimizing radiant heat transfer from combustion chamber 16 to the surface upon which heater 10 is located. A further enhancement of efficiency results from the flow of combustion air over the surface upon which heater 10 rests, since that surface inevitably will be heated to some extent in spite of the other efficiency-enhancing features of the invention as described above.

For greater clarity in understanding the construction of the high efficiency gas/water heat exchanger of the present invention, reference should also be made to FIG. 2 which shows gas/liquid heat exchanger 14, in perspective view. Heat exchanger 14, in effect, forms the bottom of tank 11 and includes annular plate 31 attached to combustion chamber 16, the outer periphery of which plate is attached to the lower edge of the tank. Hot combustion gases flow upwards through combustion chamber 16 which serves as a first heat exchange element, while transferring some heat to heat transfer medium 12, particularly through the top surface of the combustion chamber. The gases exit combustion chamber 16 at the top thereof and flow through a riser 32 to a second heat exchange element 33, the riser having a diameter substantially less than the the diameter of the second heat exchange element. Heat exchange element 33 is of generally a pancake shape, thus allowing a high surface-to-volume ratio. This shape provides a high area for heat transfer and also its narrow cross-sectional area increases the turbulence of the flowing gasses to thereby increase the rate of heat transfer to heat transfer medium 12 surrounding the element. Gases from second heat exchange element 33 then flow through three risers 34 to a third heat exchange element 36, the risers having diameters substantially less than the diameter of the third heat exchange element. It is found that three risers 34 between heat exchange elements 33 and 36 provide improved distribution of the gasses in heat exchange element 36. Heat exchange element 36 is configured the same as heat exchange element 33 to also provide increased heat transfer therefrom to the surrounding heat transfer medium 12. The gases exiting heat exchange element 36 pass upwards through vertical stack 37, from which additional heat transfer takes place and then exit from the stack at the top of heater 10. The labyrinth path followed by the gases prevents escape of radiant heat to the stack.

Because of the various efficiency-enhancing features of the present invention, the gases may exit heater 10 at a temperature in the range of 350 degrees Fahrenheit, which is close to the theoretical limit for a non-condensing system. Efficiency could be improved somewhat if the water in the gas were allowed to condense, but such operation would involve problems with handling the resulting corrosive water.

Heat transfer medium 12 is desirably held at about 180 degrees Fahrenheit and comprises a relatively large reservoir containing a substantial amount of stored heat energy.

When heating of the building with which heater 10 is associated is required, heat transfer medium 12 is drawn from the top of tank 11 where the heat transfer medium is hottest, through pipe 40, through the building heating system (not shown), is returned to heater 10 through circulator 41 and pipe 42, and is directed to impinge on the upper surface 45 of heat exchange element 36, thus providing increased temperature difference across that surface for greater heat transfer rate. Because of the relatively large reservoir of hot heat transfer medium 12, the heater 10 can supply far more heating capacity than the burner output, on an instantaneous basis.

Domestic hot water is provided without the need for a separate reservoir by introducing water from a cold water supply through pipe 43 to a heat exchanger 44 positioned in heat transfer medium 12 in tank 11. Heat exchanger 44 comprises a helically coiled pipe as shown, the surface of which is finned, as at 46, to provide a relatively large heat exchange surface in a small volume. Water heated in heat exchanger 44 exits tank 11 through pipe 47 to supply domestic hot water needs. Because of the large heat exchange surface of heat exchanger 44, the large reservoir of heat transfer medium 12, and the large burner 17 relative to ordinary domestic hot water heaters, heater 10 can easily meet high and long-term demand for domestic hot water. Since the water within coil 44 will initially be at, or close to, 180 degrees Fahrenheit when hot water is first withdrawn, a mixing valve (not shown) may be provided in pipe 47 to admix cold water to maintain the domestic hot water at a stable and usable temperature. This also increases the apparent volume of domestic hot water available.

To provide heater 10 having a long life, it has been found preferable to fabricate the heater entirely of welded stainless steel, preferably, but not necessarily, of Grade 310 for heat exchanger 14 and Grade 304-L for tank 11, except for finned domestic hot water heat exchanger 44 which is fabricated of copper or copper alloy. Grade 310 stainless steel is a particularly good choice for heat exchanger 14 as that material is an especially good absorber of radiant energy, thus further enhancing the overall heat transfer rate and the efficiency of the unit.

In one embodiment, it has been found that with 60 gallons of water as the heat transfer medium, a 100,000 BTU-per-hour gas burner, and a 180 degree Fahrenheit water storage temperature, both space heating and domestic hot water needs can be met for a typical residence, while consuming close to the theoretical minimum fuel.

It will thus be seen that the objects set forth above, among those made apparent from the preceding description, are efficiently attained and, since certain changes may be made in the above construction without departing from the scope of the invention, it is intended that all matter contained in the above description or shown on the accompanying Drawing shall be interpreted as illustrative and not in a limited sense.

It is also to be understood that the following claims are intended to cover all of the generic and specific features of the invention herein described, and all statements of the scope of the invention which, as a matter of language, might be said to fall therebetween.

I claim:

1. A combination space heating and tankless hot water heater, comprising:

(a) a vertical closed tank, having upper and lower ends, adapted to hold a large reservoir of liquid heat transfer medium therewithin;

(b) a high-efficiency gas/liquid heat exchanger disposed within said tank, comprising:

(i) a generally cylindrical combustion chamber disposed at said lower end of said tank;

(ii) a plurality of pancake-shaped cylindrical heat exchange elements, having diameter dimensions substantially greater than heighth dimensions, lying one above another, and with their diameters perpendicular to the longitudinal axis of said tank;

(iii) risers, having diameters substantially less than the diameters of said pancake-shaped heat exchange elements, serially connecting said heat exchange elements to each other and to said combustion chamber; and (iv) a stack connected to the uppermost of said heat exchange elements and rising vertically through said upper end of said tank; whereby, combustion gases generated in said combustion chamber can flow upwards through said chamber, then serially through said heat exchange elements, and then through said stack to exit said tank;

(c) burner means disposed within said generally cylindrical combustion chamber to provide hot gases to flow upwards through said gas/liquid heat exchanger for transfer of heat from said gases across the walls of said gas/liquid heat exchanger and to said heat transfer medium;

(d) means for withdrawing and returning said heat transfer medium from and to said tank to supply said heat transfer medium to means for forced circulation for space heating;

(e) heat exchanger means disposed within said tank for receiving cold water and supplying domestic hot water; and (f) a baffle arrangement disposed in said lower end of said combustion chamber and lying underneath said burner substantially preventing any surface upon which said tank is supported from receiving radiant heat transfer from said burner and causing some combustion air to said burner means to flow across and cool a portion of the surface upon which said combination space heating and tankless hot water heater is supported.

2. A combination space heating and tankless hot water heater, as defined in claim 1, further comprising:

(a) a portion of said combustion chamber extending below said lower end of said tank;

(b) a cylindrical skirt supporting said tank and spaced from and surrounding said portion of said combustion chamber; and (c) said portion of said combustion chamber and said cylindrical skirt defining openings therein through which combustion air for said burner can flow to said burner, the flow path of at least some of said air arranged so as to cool the underside of said baffle arrangement underneath said burner and a further portion of the surface upon which said combination space heating and tankless hot water heater is supported.

3. A combination space heating and tankless hot water heater, as defined in claim 2, wherein said air flow through said openings is arranged so as to substantially prevent convective heat transfer from said combustion chamber to the surroundings.

* * * * *